US007902443B2

(12) United States Patent
Legere et al.

(10) Patent No.: US 7,902,443 B2
(45) Date of Patent: Mar. 8, 2011

(54) ORIENTED POLYMER REEDS FOR WOODWIND INSTRUMENTS

(76) Inventors: Guy Legere, Barrie (CA); Mark Kortschot, Unionville (CA)

( * ) Notice: Subject to any disclaimer, the term of this patent is extended or adjusted under 35 U.S.C. 154(b) by 156 days.

(21) Appl. No.: 12/155,475

(22) Filed: Jun. 4, 2008

(65) Prior Publication Data

US 2009/0301284 A1 Dec. 10, 2009

(51) Int. Cl.
*G10B 3/00* (2006.01)

(52) U.S. Cl. ..... 84/363

(58) Field of Classification Search ..... 84/330, 84/363, 383 A, 380 A
See application file for complete search history.

(56) References Cited

U.S. PATENT DOCUMENTS 3,340,759 A 9/1967 Petzke
3,420,132 A 1/1969 Backus
3,705,820 A 12/1972 Knotik et al.
3,759,132 A 9/1973 Backus
3,905,268 A 9/1975 Gamble
4,014,241 A 3/1977 Gamble
4,145,949 A 3/1979 Kilian
4,337,683 A 7/1982 Backus
4,355,560 A 10/1982 Shaffer
5,227,572 A 7/1993 Cusack et al.
5,521,000 A * 5/1996 Owens ..... 442/218
5,542,331 A 8/1996 Hartmann et al.
6,087,571 A * 7/2000 Legere ..... 84/383 A

OTHER PUBLICATIONS

Bourmaud et al, Investigation on Mechanical Properties of Polypropylene and Polylactic Acid Reinforced by Miscanthus Fibers, 2008 Elsevier, Ltd.*

* cited by examiner

*Primary Examiner* — Kimberly R Lockett
(74) *Attorney, Agent, or Firm* — Lynn C. Schumacher; Hill & Schumacher

(57) ABSTRACT

A synthetic reed for use in reed-blown wind instruments such as the clarinets, saxophones, oboes and bassoons may be made from an oriented thermoplastic material such as uniaxially oriented polypropylene. The reed may have a profile that is thinner near the tip and in the vamp than the profile of a cane reed of equivalent playing strength, and may be machined from an oriented polymer blank has a higher longitudinal modulus than that of said cane reed of equivalent playing strength.

27 Claims, 1 Drawing Sheet

10

ORIENTED POLYMER REEDS FOR WOODWIND INSTRUMENTS

FIELD OF THE INVENTION

This invention relates to a synthetic reed for wind instruments.

BACKGROUND OF THE INVENTION

Reed-blown wind instruments include the clarinet, saxophone, bagpipe, oboe and bassoon. In single reed instruments such as the saxophone and clarinet, a vibrating plate, clamped to the mouthpiece, sets up a standing wave in the barrel of the instrument, and the frequency of these waves is controlled by the musician. The vibrating plate is called the reed, and it is normally made of a natural cane material. The musician creates the vibration by blowing into the gap between the reed and the mouthpiece, which creates and maintains a standing wave in the barrel of the instrument. In the oboe and bassoon, a double reed is used.

Natural cane is the preferred material for the construction of reeds. Apparently, the material properties of natural cane are ideal for the construction of reeds, and reeds made of this material are generally acknowledged to be superior to those made of other materials. Nevertheless, natural cane reeds have many disadvantages. Because the material comes from a natural source, there is a variation in material properties which results in a variation in playing characteristics. Thus, not every reed purchased will be found suitable for playing. Secondly, the reed is hygroscopic, and must be conditioned by exposing it to water or saliva prior to playing. A cane reed that has been properly conditioned with water or saliva is referred to herein as a conditioned cane reed or a reed in its playing condition. Thirdly, cane is prone to splitting along the grain, which causes the reed to become unplayable. Fourthly, the reed material gradually breaks down under the influence of high frequency, low amplitude fatigue to which it is subjected.

As a result of these deficiencies, many inventors have proposed modifications of the reed structure. There have been three basic approaches to produce improved reeds: treatment of natural cane, alternative materials, and alternative materials together with a modified reed configuration.

There is considerable uncertainty in the literature regarding the material properties and configuration required to produce acceptable tonal quality. As a result, in one approach, discussed in U.S. Pat. Nos. 3,340,759, 3,705,820 and 4,145,949, synthetic coatings and penetrating resins are used on the natural cane reed to improve its resistance to water and its durability. Not all of the deficiencies of natural cane are addressed through these methods, however, and so alternative materials and reed configurations have been proposed.

The second principle method of creating an improved reed is to use a material with properties similar to those of cane. However, there is considerable confusion in the literature as to which material and structural properties are important. U.S. Pat. No. 3,420,132 suggests that the stiffness, density and viscous damping are the important material properties, and also discusses several features of the configuration that control the sound quality. U.S. Pat. No. 3,759,132 cites the properties of wet cane, suggesting that these are more important than the properties of dry cane. In U.S. Pat. No. 3,905,268 the ratio of modulus/mass is cited as being important. As used herein, the term modulus is used to denote the elastic modulus or Young's modulus of a material. Furthermore, U.S. Pat. No. 4,355,560 suggests that the individual modulus and density need not be similar to those of cane, provided the ratio of modulus to density (termed the "acoustic impedance") is similar to that of cane. U.S. Pat. No. 4,014,241 suggests that bending stiffness both transverse and parallel to the long axis of the reed is important. However U.S. Pat. No. 6,087,571 proposes a reed with a conventional shape made from a synthetic material with a matched longitudinal modulus and density, with no attempt to match the transverse modulus or bending stiffness.

The importance of viscous damping is discussed in U.S. Pat. Nos. 3,420,132, 4,337,683, and 5,542,331, but many other patents ignore this property. In U.S. Pat. No. 5,542,331, a means of controlling damping through the inclusion of special damping materials such as hollow fibers is disclosed. U.S. Pat. No. 5,227,572 suggests that the tone of a titanium reed can be controlled by heat treatment to alter the hardness. In this same patent, the failure of previous metal reeds to simulate the "fibratory response of cane" was attributed to the "ductal nature of the metal".

The preceding discussion indicates that there is still considerable confusion in the art about the important properties of cane for reproducing the tonal qualities of a natural cane reed.

None of the isotropic polymers known in the art with a density sufficiently low to match that of either dry or conditioned cane have an elastic modulus which is as high as that of either dry or conditioned cane in the fiber direction. For example, isotropic polypropylene, with a density of approximately 0.91 g/mL, has an elastic modulus of approximately 1.0 to 2.7 GPa, less than half of the typical modulus of cane in the fiber direction. Polymer-composite materials having sufficient modulus, such as carbon fiber reinforced epoxy, generally have higher densities, as do all metals. In fact, U.S. Pat. No. 3,759,132 teaches that common plastics are unsuitable because of their low modulus and relatively high density, and that composite materials such as glass fiber reinforced plastic are difficult to use because they tend to split.

The density of polymers and composites can be reduced by inclusion of hollow elements, such as hollow glass microballoons. For example, U.S. Pat. No. 4,337,683 proposes the use of graphite/epoxy composite ribs spaced with epoxy/microballoon composite regions to achieve the desired bending stiffness and mass for the reed. U.S. Pat. No. 3,759,132 suggests the use of metal ribs spaced with low density material for the same purpose. However, U.S. Pat. No. 3,420,132 teaches that the last ¼ to ⅜ of an inch of the very tip of the reed controls the elastic response. In this region, the tip may be as thin as 100 micrometers (or 0.004"), and hence complicated ribbed or shaped structures are very difficult to obtain in a reproducible way.

Many investigators consider the linear mass distribution and overall bending stiffness to be more important than the modulus and density of the material used to manufacture the reed, leading to the third principle method of creating an improved reed. These investigators have suggested an overall reed shape which is different to that of the conventional reed in order to deliver the required bending stiffness and mass distribution. Even with materials of low modulus and/or higher density than cane, the bending stiffness to mass ratio can be made equivalent to that of a cane reed by an increase in the cross-sectional moment of inertia.

For example, U.S. Pat. No. 3,905,268 suggests an arched transverse cross-section with longitudinal ridges to produce a higher moment of inertia than that of the conventional cane reed cross-section. In U.S. Pat. No. 4,014,241, a multitude of longitudinal channels are used in a synthetic material, in order to match both the longitudinal and transverse bending stiffness of a cane reed. Cane is anisotropic, with a longitudinal modulus substantially greater than the transverse modulus. Reeds with complex cross-sectional shapes are not generally available commercially, suggesting that this method fails to reproduce the performance of a standard cane reed.

U.S. Pat. No. 6,087,571 discloses a synthetic reed made from an oriented semicrystalline polymer such as polypropylene. Semicrystalline polymers can be uniaxially drawn in the solid state by any one of a number of processes including hydrostatic extrusion, ram extrusion, tensile drawing, die drawing, rolling, or roll-drawing. By uniaxially drawing a semicrystalline polymer at a temperature below its melting temperature, the modulus in the draw direction may be increased to be similar to that of conditioned cane in the fiber direction.

U.S. Pat. No. 6,087,571 discloses a method of manufacturing a synthetic reed comprising the following steps (a) providing a blank of an oriented semi-crystalline polymer having a longitudinal modulus and density which are similar to those of cane; and, (b) machining the blank to the approximate shape and size of a conventional cane reed while maintaining the temperature in a substantial portion of the oriented polymer blank below the melting temperature of the polymer.

U.S. Pat. No. 6,087,571 states that a uniaxially drawn polymer will preferably have approximately the same modulus as its isotropic precursor in a plane having the draw direction as its normal vector, where the reed is to be machined so that it has a primary vibratory axis parallel to the direction of orientation of the thermoplastic material. U.S. Pat. No. 6,087,571 also discloses another embodiment, in which the oriented semi-crystalline thermoplastic is biaxially oriented to yield elevated modulus and strength in both the transverse and longitudinal directions where the reed is to be machined so that it has a primary vibratory axis parallel to the longitudinal direction.

For a particular instrument, such as the clarinet, a manufacturer will typically produce cane reeds with a variety of cuts and a range of playing strengths. The "cut" of the reed refers to the basic reed shape. Each cut is generally given a particular model name. For single reed instruments, the playing strength is actually a measure of the bending stiffness of the reed parallel to the fiber direction. For a given cut of reed, in order to produce a stiffer reed, most cane reed manufacturers simply machine the reed from cane with a higher elastic modulus, while keeping the thickness and shape similar to those of other reeds of the different strengths.

The longitudinal modulus of oriented polymer reeds can be altered by changing the draw ratio used during solid state deformation. A higher draw ratio leads to more perfect molecular alignment and a higher elastic modulus in the draw direction. Hence it is possible to manufacture a range of strengths for oriented polymer reeds of a particular cut by machining the reeds from material with a range of elastic modulus, mimicking the procedure most commonly used to produce a range of strengths in cane reeds.

U.S. Pat. No. 6,087,571 teaches that an acceptable reed may be machined from an oriented polymeric material with approximately the same modulus as that of the cane in a conditioned cane reed of equivalent playing strength where the modulus is measured parallel to the long axis of the reed, and where the shape and thickness of the oriented polymer reed is also about the same as that of the cane reed of equivalent playing strength.

For uniaxially drawn polymers, U.S. Pat. No. 6,087,571 suggests that transverse modulus of the oriented material is preferably similar to that of its isotropic precursor. For biaxially drawn polymers, U.S. Pat. No. 6,087,571 suggests that transverse modulus of the oriented material is greater than that of its isotropic precursor. In both cases, the transverse bending stiffness of the oriented polymer reed will be higher than that of a cane reed of equivalent playing strength, since the modulus of conditioned cane perpendicular to the fiber direction is significantly lower than that of most isotropic semicrystalline polymers, and in particular, is significantly lower than that of isotropic polypropylene.

U.S. Pat. No. 6,087,571 has been used as the basis for manufacturing commercially successful synthetic reeds by Légère Reeds Ltd. since 1998. Many professional musicians have been satisfied with the quality of the oriented polymer reeds produced according to the teaching of U.S. Pat. No. 6,087,571. Nevertheless, other musicians have expressed the opinion that Légère's synthetic reeds are not as good as the best cane reeds. Specifically, it has been suggested that the synthetic reeds made according to the teachings of U.S. Pat. No. 6,087,571 lack some "warmth" or "color", where these descriptors are generally used to express some subtlety of the sound, and may be affected by higher order overtones.

Therefore it would be very advantageous to provide synthetic reeds which overcome the aforementioned shortcomings.

SUMMARY OF THE PRESENT INVENTION

In accordance with the present invention, there is provided a synthetic reed for reed-blown wind instruments made from uniaxially oriented semicrystalline thermoplastics such as polyethylene and polypropylene. Surprisingly, it has been found that making an oriented polymer reed that is both thinner and has a higher longitudinal modulus than that of a cane reed of equivalent playing strength, experienced players perceive additional color and warmth in the sound produced when the reed is played.

The present invention provides a reed that has a longitudinal bending stiffness very similar to that of a conditioned cane reed of equivalent playing strength and also has a transverse bending stiffness similar to that of a conditioned cane reed of equivalent playing strength. Cane has a modulus transverse to the fiber direction significantly less than the transverse modulus of a typical uniaxially oriented semi-crystalline polymer. Consequently, it has been discovered that an oriented polypropylene reed made according to the teachings of U.S. Pat. No. 6,087,571 has a transverse bending stiffness significantly higher than that of a conditioned cane reed of equivalent playing strength.

By machining a uniaxially oriented polymer reed so that it is thinner in at least the tip and vamp regions than a cane reed of equivalent playing strength, the transverse bending stiffness of said uniaxially oriented polymer reed can be reduced so that it is similar to that of said cane reed, even though it is made from a material with higher modulus transverse to the long axis of the reed than that of said cane reed. In order to match the longitudinal bending stiffness and hence playing strength of a conditioned cane reed using a uniaxially oriented polymer reed of reduced thickness, the longitudinal modulus of the said oriented polymer reed, parallel to the orientation direction and the long axis of the reed, must be higher than that of the cane in said conditioned cane reed, parallel to the fiber direction.

Preferably, if the thickness of the oriented polymer reed is set equal to a factor times the thickness of a conditioned cane reed of equivalent playing strength at every location that bends during reed vibration, where said factor is less than one, the oriented polymer reed is made from a material with a modulus equal to approximately the cube of the reciprocal of said factortimes the modulus of the cane in the conditioned cane reed. For example, if the thickness of the oriented polymer reed is set equal to 0.8 times the thickness of a conditioned cane reed at every location that bends during reed vibration, the oriented polymer reed would be made from a material with a modulus equal to approximately 1.95 times the modulus of the cane in said cane reed to produce equivalent longitudinal bending stiffness, and hence equivalent playing strength. Surprisingly, a 20% reduction in thickness from that of reeds made according to the teachings of U.S. Pat. No. 6,087,571 results in a significant amount of additional color in the sound produced by the reed, and professional musicians perceive reeds made according to the present invention to be superior to those produced according to the teachings of U.S. Pat. No. 6,087,571.

For reeds of a given playing strength, increasing the longitudinal modulus of the oriented polymer from which they are made and reducing the thickness results in more transverse flexibility of the vamp and tip regions, very surprisingly and unexpectedly producing richer and more colorful sounds.

Thus, pursuant to the present invention there is provided a synthetic reed for reed-blown wind instruments comprising a heel portion extended by a vamp portion which tapers to a tip, said synthetic reed being made of an oriented semi-crystalline thermoplastic material having a longitudinal modulus substantially higher than that of cane in a conditioned cane reed of equivalent playing strength.

The present invention also provides a product line of synthetic reeds for reed-blown wind instruments comprising a series of at least two synthetic reeds as described above with differing playing strengths, wherein the at least two synthetic reeds are made from oriented semi-crystalline thermoplastics with different elastic moduli.

Pursuant to the present invention, a method of manufacturing a synthetic reed for reed-blown wind instruments of a conventional size for reed-blown wind instruments comprising a heel portion extended by a vamp portion which tapers to a tip portion. The method comprising the steps of:

a) providing a blank of a uniaxially oriented semi-crystalline thermoplastic material having a longitudinal modulus that is substantially higher than the longitudinal modulus of the cane in a conditioned cane reed with a playing strength about the same as the playing strength of the oriented polymer reed to be made from said blank; and b) machining the blank to a synthetic reed that has a similar size and shape to a conventional cane reed of equivalent playing strength, but has a thickness less than that of said cane reed in at least the tip and vamp portion of the synthetic reed, while maintaining a temperature in a substantial portion of the oriented polymer blank below a melting temperature of the polymer.

The final machined shape of the oriented polymer reed is preferably similar to the shape of a conventional cane reed of equivalent playing strength, except that the thickness in at least the tip and vamp regions has been reduced from that of said conventional cane reed.

The oriented polymer blank may be manufactured by any one of a number of processes which are capable of imparting orientation to the polymer molecules including hydrostatic extrusion, ram extrusion, tensile drawing, die drawing, compression molding, rolling, and roll-drawing. In such processes, the polymer is typically heated to a temperature below its melting point, extended in one direction to impart molecular orientation, and quenched to lock in said orientation.

In some cases, orientation may also be obtained through flow induced crystallization during processing at temperatures greater than the melt temperature. Such oriented polymers have a tensile modulus much higher than their isotropic precursors, and can be produced with any specific modulus, up to a limit, by suitable control of the extent of orientation. By such processes, oriented-thermoplastic blanks with similar density and a higher modulus than natural cane in its playing condition can be produced. These blanks can then be machined into reeds which produce a sound similar to that produced when conventional cane reeds are used with reed-blown wind instruments.

A further understanding of the functional and advantageous aspects of the invention can be realized by reference to the following detailed description and drawings.

BRIEF DESCRIPTION OF THE DRAWINGS

The invention will be more fully understood from the following detailed description thereof taken in connection with the accompanying drawings, which form a part of this application, and in which.

DESCRIPTION OF PREFERRED EMBODIMENT

Figure 1:
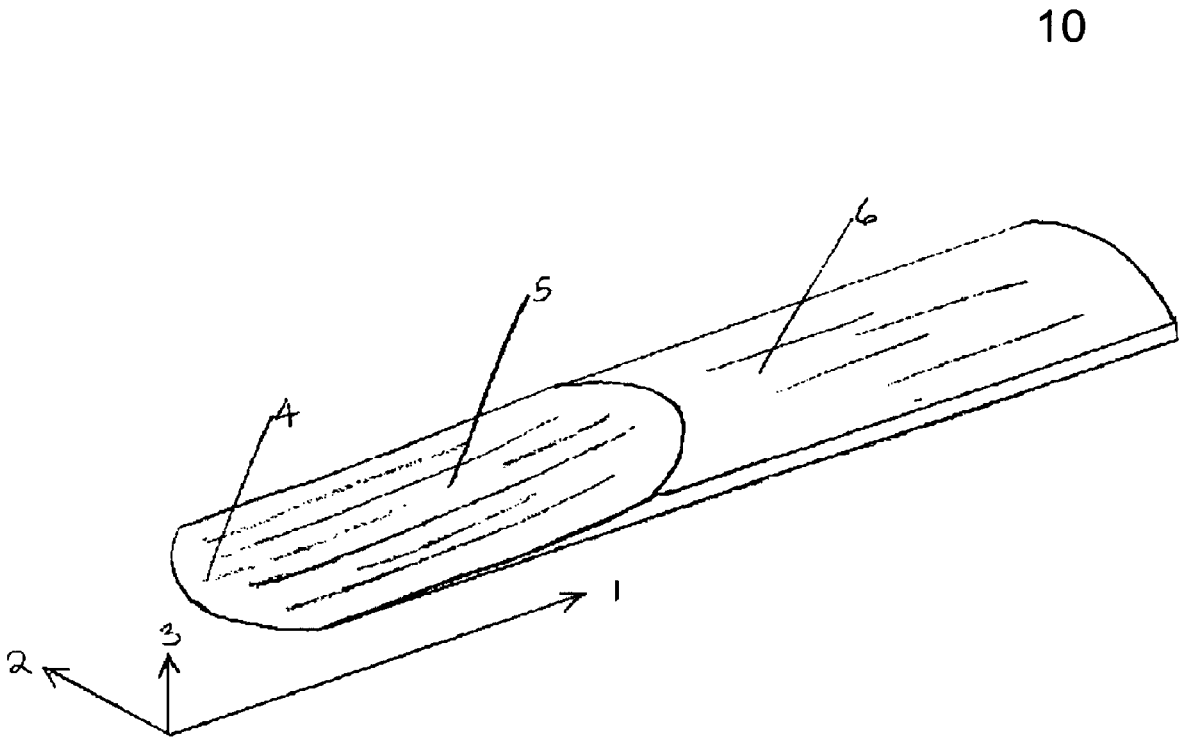
FIG. 1 illustrates a woodwind reed for a single reed instrument such as a clarinet or saxophone produced in accordance with the present invention.

Generally speaking, the systems described herein are directed to oriented polymer reeds for woodwind instruments. As required, embodiments of the present invention are disclosed herein. However, the disclosed embodiments are merely exemplary, and it should be understood that the invention may be embodied in many various and alternative forms. The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to oriented polymer reeds for woodwind instruments.

As used herein, the term "about", when used in conjunction with ranges of dimensions, temperatures, ranges in modulus, or other physical properties or characteristics is meant to cover slight variations that may exist in the upper and lower limits of the ranges of dimensions so as to not exclude embodiments where on average most of the dimensions are satisfied but where statistically dimensions may exist outside this region.

As used herein, the term modulus is used to denote the elastic modulus or Young's modulus of a material.

Sound producing reeds described in this patent may be used in any reed-blown wind instruments and are preferably used in the clarinet, saxophone, bagpipe, oboe, and bassoon. For each individual instrument, a conventional cane reed has a distinctive shape and size. Since the oriented polymer reeds described herein are intended to be made from material which has a modulus in both the longitudinal and transverse directions that is greater than that of the cane in a conditioned cane reed of equivalent playing strength, the shape and size of an oriented polymer reed for any given instrument and cut of reed may be similar to that of the corresponding conventional cane reed except that the thickness is reduced in at least the tip and vamp regions so that the longitudinal bending stiffness is matched to that of a cane reed of equivalent playing strength.

The longitudinal modulus of the oriented polymer in an oriented polymer reed made according to the present invention may be at least 20% higher than that of a cane in a conditioned cane reed of equivalent playing strength, and is preferably is at least 35% higher than that of cane in a conditioned cane reed of equivalent playing strength. It is noted that cane has a range of modulus, and high modulus cane is used to make the stiffer reeds that may be used by more experienced players. The so called "strength" range for reeds is generally from 1 to 5, where 5 is a high stiffness reed (a "strong" reed). So, in the present invention, if one is making a #2 or soft reed from an oriented polymer, a material is used with a modulus higher than the modulus of the conditioned cane in a corresponding #2 cane reed. However, the #2 oriented polymer reed so constructed might be made from an oriented polymer with the same modulus as that of the conditioned cane in a #5 cane reed. Thus, one always compares the modulus of the oriented polymer in an oriented polymer reed to the longitudinal modulus of the cane in a conditioned cane reed of equivalent playing strength.

Referring to FIG. 1, there is shown an oriented polymer woodwind reed 10 for a single reed instrument such as a clarinet or saxophone produced in accordance with the present invention. In FIG. 1, the number 1 represents the longitudinal direction, which corresponds to the fiber direction in a cane reed or the draw direction in an oriented polymer reed, or the orientation direction in a uniaxially oriented polymer reed. The longitudinal direction 1 is the primary vibratory axis of the reed. The number 2 represents the transverse direction, the number 3 is the thickness direction, the number 4 is showing the tip region, the number 5 is the vamp and number 6 is the heel.

In one embodiment, the oriented semi-crystalline thermoplastic from which the oriented polymer woodwind reed 10 is constructed is uniaxially oriented and has a modulus in one direction that is substantially higher than that of a conditioned cane reed with a playing strength equal to that of the playing strength of the synthetic reed to be manufactured from said polymer, the polymer preferably having approximately the same modulus as its isotropic precursor in a plane having the draw direction as its normal vector, and the reed 10 has a primary vibratory axis parallel to the direction of orientation of the thermoplastic material. The thickness of the reed 10 is lower everywhere that the reed bends (ie. in the tip region 4 and vamp region 5). Since the heel 6 does not generally bend significantly it does not need to be thinned.

In one embodiment, the oriented polymer woodwind reed 10 Is constructed using a uniaxially oriented isotactic polypropylene having a modulus in one direction that is substantially higher than that of the cane in a conditioned cane reed with a playing strength equal to that of the playing strength of the synthetic reed to be manufactured from said polypropylene, said oriented polypropylene preferably having approximately the same modulus as its isotropic precursor in the transverse direction, and the reed has a primary vibratory axis parallel to the direction of orientation of the thermoplastic material.

In a preferred embodiment of the current invention, the oriented polymer woodwind reed 10 is constructed using a uniaxially oriented polypropylene sheet with a specific gravity in a range from about 0.9 to about 0.92, and a modulus in the draw direction in a range from about 6 to about 20 GPa. This material may be obtained by any one of a number of processes including hydrostatic extrusion, ram extrusion, tensile drawing, die drawing, rolling, or roll-drawing. The molecular weight distribution, initial crystalline morphology, and draw conditions are selected to produce the required properties.

The sheet material is cut into reed blanks with a length in a range from about 90 mm to about 120 mm, a width of between about 20 mm to about 25 mm and a thickness of between about 3 and about 5 mm, where the specific dimensions depend on the size of the reed to be machined. These blanks may be machined in a computer numerical controlled milling machine using a polycrystalline diamond cutter to the shape of a conventional cane reed of equivalent playing strength, but where the thickness in at least the tip region 4 and vamp region 5 is reduced from that of a conventional cane reed of equivalent playing strength.

Preferably, the thickness of the oriented polymer woodwind reed 10 is set equal to a factor Z times the thickness of a cane reed of equivalent playing strength at every location that bends during reed vibration, where Z is a scaling factor between about 0.6 and about 0.9, and the said oriented polymer reed 10 is made from a uniaxially oriented polymer with a modulus equal to about $(1/Z)^3$ times the modulus of said cane reed. The transverse bending stiffness of a reed 10 made in this way is substantially lower than that of a reed of equivalent playing strength made according to the teachings of U.S. Pat. No. 6,087,571.

Surprisingly, it has been found that synthetic reeds with substantially the same longitudinal and transverse bending stiffness as conditioned cane reeds may be prepared from uniaxially oriented semicrystalline thermoplastics.

The reed of the present invention may have a thickness that is reduced from that of a conventional cane reed everywhere, however it is the parts that bend during playing that are important, specifically the tip region 4 and vamp region 5. The heel 6 does not generally bend significantly during playing, so it does not need to be thinned. In practice however, if the vamp 5 is thinned and the overall reed length and heel length are to match those of a conventional cane reed, the heel will preferably be thinned also, so that the vamp 5 meets the heel 6 at the same longitudinal location along the reed.

Thermoplastic materials which may be so used comprise those, which after orientation, have a density similar to that of the cane in a conditioned cane reed, and a longitudinal modulus substantially greater than that of the cane in a conditioned cane reed. The oriented thermoplastic may be semicrystalline. Preferably, the oriented thermoplastic has a density from about 0.8 to about 1.3 g/mL, more preferably a density from about 0.9 to about 1.1 g/mL and most preferably a density from about 0.9 to about 0.97 g/mL. Further, the oriented thermoplastic has a modulus in the draw direction from about 4 to about 20 GPa, more preferably from about 5 to about 18 GPa and most preferably from about 5 to about 16 GPa. The preferred thermoplastic materials are polyethylene or polypropylene. The most preferred material is isotactic polypropylene.

The elastic modulus of the polymer may be increased by orienting and extending the molecules in one direction. The degree of orientation can be closely controlled through the processing parameters, and hence a controlled longitudinal modulus can be produced. It is noted that the reed 10 does not need to be biaxially oriented to produce elevated transverse modulus, rather a key feature of the present invention is that the transverse bending stiffness of the reed 10 is low so that it matches, as closely as possible, that of a conditioned cane reed.

Polymer orientation can be accomplished by a class of processes which are generally termed "solid phase deformation processes". Typically, a semicrystalline thermoplastic polymer such as polyethylene or polypropylene is heated to a temperature below its melt temperature, subjected to an extensional flow field, and the temperature is rapidly reduced while the material is held in its extended state. Polymer orientation can also be accomplished in amorphous thermoplastics, but the degree of modulus improvement obtained in semicrystalline thermoplastics is much greater, and these materials are more preferred for synthetic reed blanks. In some cases, polymer orientation can also be obtained during processes at temperatures above the melt temperature in semicrystalline thermoplastics by flow-induced crystallization.

In general, any process producing extensional flow can also be used to produce an oriented polymer which enhances stiffness provided the operating conditions are correct. For example, polypropylene billets may be heated to 155-160.degree. C. in an oven, and fed through a four roll mill. The first two sets of rolls are heated, and the second set of rolls rotates more quickly than the first set, so that the material is pulled in tension between them, elongating and being reduced in both thickness and width. The third and fourth sets of rolls are at room temperature, and serve to provide traction and chilling. The result is a polymer strip with a degree of orientation dependent on the draw ratio. The draw ratio is equal to the length of the final drawn strip of polypropylene divided by the length of the original billet.

The elastic modulus in the draw direction is a function of draw ratio, varying for example, from about 1.0 to about 2.7 GPa in unoriented polypropylene, and up to about 16 GPa in polyproylene processed with a draw ratio of about 16. (Burke, P. E., Weatherly, G. C., Woodhams, R. T., Polym. Eg. Sci., 27, pp. 518-523, 1987). The relationship between draw ratio and modulus is a function of a number of other parameters such as molecular weight, initial crystallinity and crystalline morphology, processing temperature, etc.

Other methods for inducing uniaxial polymer orientation can be employed to produce anisotropic polymers with a modulus in the draw direction greater than that of the isotropic polymer. These include simple tensile drawing processes (U.S. Pat. No. 4,268,470), extrusion followed by tensile drawing of the hot extrudate (U.S. Pat. No. 5,399,308) and, solid-state extrusion (Zachariades, A. E., Mead, W. T., Porter, R. S., "Recent Developments in Ultramolecular Orientation of Polyethylene by Solid State Extrusion", in Ultra-High Modulus Polymers, ed. Ciferri, A., Ward, I. M., Applied Science Publishers, London, 1979).

The uniaxially oriented materials may be transversely isotropic, with enhanced properties in the draw direction and properties similar to those of the undrawn polymer in all directions in the plane transverse to the draw direction. The transverse properties may also be slightly increased or reduced by uniaxial orientation depending on the polymer grade and processing conditions.

A distinguishing characteristic of oriented semi-crystalline thermoplastics is that if they are heated to their melting temperature without any external restraint, they will contract in any direction where there is preferential orientation. Accordingly, uniaxially oriented sheets such as a roll-drawn strip of polypropylene, when so heated will shrink in the draw direction and expand in at least one principle axis transverse to the draw direction. According to the present invention, all oriented thermoplastics which undergo such shrinkage upon heating may be used as a blank for machining wood-wind reeds.

Because heating causes entropic relaxation of the polymer, the process of machining the reed blank into a finished reed should be conducted without heating the polymer above its melting point.

By suitably choosing the orientation process, raw material, and processing conditions, it is possible to produce a synthetic reed with substantially the same longitudinal bending stiffness and transverse bending stiffness as those of conditioned cane reeds.

For a particular instrument, such as the clarinet, and a given cut of reed, it is advantageous to produce reeds with a variety of playing strengths to produce a product line suitable for a variety of players. According to the present invention, a product line comprising at least two oriented polymer reeds of the same cut but with differing playing strengths may be produced by machining said reeds from blanks of differing elastic modulus, where each of said reeds in said product line is machined from an oriented polymer with a significantly higher longitudinal modulus than that of the cane in a conditioned cane reed of about the same playing strength.

The present invention is illustrated using the following non-limiting example, and those skilled in the art will understand that this example is not be interpreted as limiting in any way.

EXAMPLE

An extruded sheet of 19.7 mm thick semicrystalline isotactic polypropylene was cut into a billet approximately 109 mm wide and 368 mm long. The billet was placed in an oven at a temperature of 160° C. for 1 hour 20 minutes. The billet was rapidly removed from the oven and was quickly transferred to a pair of grips, one of which was stationary, and the other of which was attached to the extended cable of an electric winch. The initial distance between the grips was about 305 mm. Once secured in the grips, the specimen was elongated at room temperature at a rate of 9 ft per minute, and the elongation was stopped when the final distance between the grips was about 3734 mm.

The billet displayed a uniform draw, with reductions in both thickness and width approximately proportional to the original thickness and width, respectively. The nominal draw ratio is calculated as the final distance between the grips divided by the original distance between the grips, and for this example, the nominal draw ratio was about 12.25. The drawn billet was cut into several lengths of approximately 100 mm, these pieces being the precursors for individual reeds, and hereinafter referred to as blanks. A blank from the centre of the drawn billet was planed with a helical cutter to a thickness of approximately 4.5 mm. The edges of the blank were tapered to match the tapered width of a conventional b-flat clarinet reed.

The tapered blank was transferred to a three-axis computer controlled cutting machine, where it was held in place with a combination of vacuum and mechanical clamps. The cutting surface used was a polycrystalline diamond cutter spinning at approximately 10,000 r.p.m. The shape of the final reed was created using a predefined profile to drive the CNC machine, and was similar to that of a conventional b-flat clarinet reed, except that the thickness was scaled everywhere by a factor of 0.8. The machined blank was removed from the CNC machine, and the tip and heel were trimmed to the desired point.

The finished reed was given to a professional clarinet player for evaluation purposes. The reed was judged by the professional clarinet player to have a sound very similar to that of a good cane reed, and to be superior to other synthetic reeds, including those reeds made according to the teaching of U.S. Pat. No. 6,087,571.

As used herein, the terms "comprises", "comprising", "includes" and "including" are to be construed as being inclusive and open ended, and not exclusive. Specifically, when used in this specification including claims, the terms "comprises", "comprising", "includes" and "including" and variations thereof mean the specified features, steps or components are included. These terms are not to be interpreted to exclude the presence of other features, steps or components.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

REFERENCES CITED

U.S. Patent Documents

| | | |
|---|---|---|
| 1779522 | October 1930 | Widmayer |
| 2296737 | September 1942 | Peterson |
| 2919617 | January 1960 | Brilhart |
| 3165963 | January 1965 | Burns |
| 3267791 | August 1966 | Roberts |
| 3340759 | September 1967 | Petzke |
| 3420132 | January 1969 | Backus |
| 3705820 | December 1972 | Knotik et al. |
| 3759132 | September 1973 | Backus |
| 3905268 | September 1975 | Gamble |
| 4014241 | March 1977 | Gamble |
| 4145949 | March 1979 | Kilian |
| 4268470 | May 1981 | Capaccio et al. |
| 4282277 | August 1981 | Austen et al. |
| 4337683 | July 1982 | Backus |
| 4355560 | October 1982 | Shaffer |
| 4655679 | April 1987 | Giacomel |
| 4850925 | July 1989 | Ady |
| 4979420 | December 1990 | Cusack et al. |
| 5030402 | July 1991 | Zachariades |
| 5227572 | July 1993 | Cusack et al. |
| 5399308 | March 1995 | Woodhams et al. |
| 5542331 | August 1996 | Hartmann et al. |
| 6087571 | July 2000 | Legere |

Other References

Ward, I. M., Structure and Properties of Oriented Polymers, Applied Science Publishers Ltd. 1975, pp. 77-116.

Burke, P. E., Weatherly, G. C. and Woodhams, R. T., Uniaxial Roll-Drawing of Isotactic Polypropylene Sheet, Polymer Engineering and Science, Mid-April 1987, vol. 27, No. 7, pp. 518-523.

Therefore what is claimed is:

1. A synthetic reed for reed-blown wind instruments comprising a heel portion extended by a vamp portion which tapers to a tip, said synthetic reed being made of an oriented semi-crystalline thermoplastic material having a longitudinal modulus substantially higher than that of cane in a conditioned cane reed of equivalent playing strength.

2. The synthetic reed of claim 1 wherein the longitudinal modulus is at least 30% higher than that of said cane in a conditioned cane reed of equivalent playing strength.

3. The synthetic reed of claim 1 wherein the oriented semi-crystalline thermoplastic material has substantial shrinkage in one direction upon heating to its melting temperature in an unrestrained state.

4. The synthetic reed of claim 1 wherein the oriented semi-crystalline thermoplastic material is uniaxially oriented and has a modulus in one direction higher than that of the conditioned cane reed in the fibre direction of the conditioned cane reed, and wherein the oriented semi-crystalline thermoplastic material has approximately the same modulus as its isotropic precursor in all directions in a plane having a draw direction as its normal vector, and wherein the synthetic reed has a primary vibratory axis parallel to a direction of orientation of the oriented semi-crystalline thermoplastic material.

5. The synthetic reed of claim 1 wherein the oriented semi-crystalline thermoplastic material is manufactured by any one of roll-drawing, hydrostatic extrusion, ram extrusion, rolling, tensile drawing, die-drawing, and compression molding.

6. The synthetic reed of claim 1 wherein the oriented semi-crystalline thermoplastic material has a density in a range from about 0.8 to about 1.3 g/mL and a modulus in a range from about 3 GPa to about 18 GPa.

7. The synthetic reed of claim 1 wherein the oriented semi-crystalline thermoplastic material has a density in a range from about 0.9 to about 1.1 g/mL and a modulus in a range from about 5 to about 16 GPa.

8. The synthetic reed of claim 1 wherein the oriented semi-crystalline thermoplastic material is selected from the group consisting of polypropylene and polyethylene.

9. The synthetic reed of claim 1 wherein the oriented semi-crystalline thermoplastic material is polypropylene, and wherein the polypropylene is an oriented isotactic polypropylene.

10. The synthetic reed of claim 9 wherein the isotactic polypropylene has substantial shrinkage in one direction upon heating to its melting temperature in an unrestrained state.

11. The synthetic reed of claim 9 wherein the oriented isotactic polypropylene is uniaxially oriented and has a modulus in one direction higher than that of the cane in a conditioned cane reed of equivalent playing strength in the fibre direction, the oriented isotactic polypropylene has the approximately the same modulus as its isotropic precursor in all directions in a plane having the draw direction as its normal vector, and the synthetic reed has a primary vibratory axis parallel to the direction of orientation of the isotactic polypropylene.

12. A product line of synthetic reeds for reed-blown wind instruments comprising a series of at least two synthetic reeds as claimed in claim 1 with differing playing strengths, wherein said at least two synthetic reeds are made from oriented semi-crystalline thermoplastics with different elastic moduli.

13. The product line of claim 12 wherein the oriented semi-crystalline thermoplastic material is selected from the group consisting of polypropylene and polyethylene.

14. The product line of claim 12 wherein the oriented semi-crystalline thermoplastic material is polypropylene, and wherein the polypropylene is an oriented isotactic polypropylene.

15. The product line of claim 14 wherein the isotactic polypropylene has substantial shrinkage in one direction upon heating to its melting temperature in an unrestrained state.

16. The product line as claimed in claim 14 wherein the oriented isotactic polypropylene has a longitudinal modulus which is at least 30% higher than that of the cane in a conditioned cane reed of equivalent playing strength.

17. A method of manufacturing a synthetic reed for reed-blown wind instruments comprising a heel portion extended by a vamp portion which tapers to a tip portion, the method comprising the steps of;

a) providing a blank of a uniaxially oriented semi-crystalline thermoplastic material having a longitudinal modulus that is substantially higher than the longitudinal modulus of the cane in a conditioned cane reed with a playing strength about the same as the playing strength of the oriented polymer reed to be made from said blank; and b) machining the blank to a synthetic reed that has a similar size and shape to a conventional cane reed of equivalent playing strength, but has a thickness less than that of said cane reed in at least the tip and vamp portion of the synthetic reed, while maintaining a temperature in a substantial portion of the oriented polymer blank below a melting temperature of the polymer.

18. The method according to claim 17 wherein the oriented semi-crystalline thermoplastic material is selected from the group consisting of polypropylene and polyethylene.

19. The method according to claim 17 wherein the oriented semi-crystalline thermoplastic material is polypropylene, and wherein the polypropylene is an oriented isotactic polypropylene.

20. The method according to claim 19 wherein the isotactic polypropylene has substantial shrinkage in one direction upon heating to its melting temperature in an unrestrained state.

21. The method according to claim 20 wherein the polypropylene has a longitudinal modulus which is at least 30% higher than that of a conditioned cane reed of equivalent playing strength.

22. The method as claimed in claim 17 wherein the polymer is uniaxially oriented and the blank is machined so that the primary vibratory axis of the reed is parallel to the direction of orientation of the polymer.

23. The synthetic reed of claim 1 wherein the longitudinal modulus is at least 20% higher than that of said cane in a conditioned cane reed of equivalent playing strength.

24. The synthetic reed of claim 1 wherein said synthetic reed is thinner than said cane reed in at least the vamp and tip region.

25. The synthetic reed of claim 1 wherein the thickness of the oriented polymer reed is set equal to a factor Z times the thickness of a cane reed of equivalent playing strength at every location that bends during reed vibration, where Z is a scaling factor between about 0.6 and about 0.9, and said oriented polymer reed is made from a uniaxially oriented polymer with a modulus equal to about $(1/Z)^3$ times the modulus of said cane reed.

26. A synthetic reed for reed-blown wind instruments produced according to the method of claim 17.

27. A synthetic reed for reed-blown wind instruments produced according to the method of claim 21.

* * * * *